US005176271A

United States Patent [19]

Painchaud et al.

[11] Patent Number: 5,176,271

[45] Date of Patent: Jan. 5, 1993

[54] BOTTLE ASSEMBLY WITH IMPROVED SEAL

[75] Inventors: Michel Painchaud, Beloeil; Jean P. Richard, St. Bruno; Jean-Paul LaPointe, Montréal, all of Canada

[73] Assignee: Groupe Lavo Inc., Montreal, Canada

[21] Appl. No.: 887,938

[22] Filed: May 26, 1992

[51] Int. Cl.[5] ..... B65D 53/00

[52] U.S. Cl. ..... 215/261; 215/31; 215/232; 215/305; 215/348; 215/350

[58] Field of Search ..... 215/232, 305, 348, 349, 215/350, 351, 261

[56] References Cited

U.S. PATENT DOCUMENTS

| | | | |
|---|---|---|---|
| 3,071,276 | 1/1963 | Pellett et al. | 215/261 |
| 3,448,882 | 6/1969 | Roy | 215/261 |
| 3,521,784 | 7/1970 | Gaines et al. | 215/261 |
| 3,917,100 | 11/1975 | Dukess | 215/329 |
| 4,209,101 | 6/1980 | Brown | 215/253 |
| 4,386,712 | 6/1983 | DeWallace | 215/211 |
| 4,531,649 | 7/1985 | Shull | 215/232 |
| 4,684,554 | 8/1987 | Ou-Yang | 215/232 X |

*Primary Examiner*—Stephen Marcus
*Assistant Examiner*—Nova Stucker
*Attorney, Agent, or Firm*—Bacon & Thomas

[57] ABSTRACT

A bottle assembly for storing and retailing a liquid substance such as fabric bleach that generates gases when it is heated or contaminated. The bottle of the assembly has a neck on which a closure cap may be screwed. The neck is closed by a peelable seal made of porous plastic foam such as polystyrene, which is fixed by a pressure adhesive across the neck and sized so as to be easily graspable and peelable with two fingers with a reduced risk of contact with the substance within the bottle. Another seal made of the same porous foam is freely mounted within the cap to allow the bottle to be sealed again in a permanent manner after the peelable seal has been removed. Both seals prevents the bottle from bulging and from leaking if it is inadvertantly knocked over.

8 Claims, 2 Drawing Sheets

BOTTLE ASSEMBLY WITH IMPROVED SEAL

BACKGROUND OF THE INVENTION a) Field of the Invention

The present invention is concerned with an improved bottle assembly for use to store and retail a liquid substance that generates gases when it is heated or contaminated. Such a liquid substance may be, for example, a fabric bleach like those presently available on the market.

More particularly, the invention is concerned with an improvement in the way such a bottle assembly is sealed to allow it to breath, i.e. to let any generated gas escape therefrom, while tightly retaining the liquid therein even if the bottle is tilted horizontally and the cap is partially unscrewed or removed as it may sometimes occur by accident.

b) Brief Description of the Prior Art

All the bottle assemblies that are presently in use for storing and retailing various bleach formulations like Javel water or any other simular liquid substances that may produce gases under certain conditions, comprise a bottle made of plastic material such as polyethylene that is compatible with the bleach and gases ($O_2$, $Cl_2$, . . . ) than may be generated by the bleach when heated or contaminated with heavy metals such as iron, chromium, nickel and copper. The bottle comprises a cylindrical neck having a threaded external surface and a circular upper edge of a given external diameter that defines a circular opening.

Each assembly also comprises a cap sized to fit onto the neck, the cap having a flat inside top wall that is circular in shape and a surrounding skirt that downwardly projects from the periphery of the top wall. This skirt has an internal surface that is so threaded as to make the cap screwable onto the neck of the bottle.

Each assembly further comprises a permanent seal in the form of a disk made of a material that is compatible to the bleach. This disk is sized to fit within the cap and is glued or otherwise fixed flat onto the flat inside top wall of this cap so as to be permanently held and to bear against the upper edge of the neck to seal the bottle when the cap is screwed onto the neck.

In accordance with the most common embodiment presently available in the market, the permanent seal glued within the cap which may have a thickness of 0.040 to 0.060 inch, is made of a porous plastic foam such as expanded polystyrene or expanded polyethylene whose porosity is selected to allow the gases generated within the bottle to pass therethrough, but not the liquid bleach.

This embodiment is efficient to let the bottle breath and thus prevent it from bulging and thus becoming unsaleable whenever subjected to heat or contamination. This embodiment however is not always efficient to prevent the bottle from leaking if it is inadvertently or accidentally knocked over. Indeed, the plastic cap and bottle manufacturing tolerances as well as the capping process during filling of the bottle prevent in some cases the permanent seal to bear equally against the upper edge of the neck all along the same. As a result, leaks may occur at the junction of the edge of the neck with the seal whenever the bottle is tilted horizontally and remains as such for a certain period of time.

To tentatively solve this problem, it has already been proposed to use a peelable seal in combination with the permanent seal in the above mentioned bottle assembly.

In accordance with this other embodiment that is also presently available in the market, the neck of the bottle is hermetically closed by a peelable seal of aluminum that must be removed by the customer when he or she opens the bottle for the very first time.

Of course, this other embodiment is efficient in that it does prevent the bottle from leaking if it is accidentally knocked down and the cap has been inadvertently partially unscrewed or removed. However this embodiment has three drawbacks.

The first one of these drawbacks is that induction heat is required to glue the aluminum seal onto the neck of the bottle. Because this aluminum seal is very thin and may easily fall out of the cap during the capping process, it is usually glued by a spot of wax onto the bottom surface of the permanent seal or laminated thereto with wax. After screwing of the cap onto the neck, induction heat is and must be applied to the neck and cap assembly to cause the aluminum seal whose bottom surface is covered by a layer of heat activated otherwise, to be glued onto the upper edge of the neck and simultaneously to be released from the permanent seal by melting of the spot of wax.

The second and most important drawback of this other embodiment is that the aluminum seal once it is glued onto the neck of the bottle, completely prevents the same from breathing, because of its hermetism to both liquids and gases. As a result, bulging may occur and causes some bottles to be unsaleable.

The third and last drawback of this other embodiment is that the aluminum seal once it is glued, is rather difficult to peal off, essentially because the seal itself is usually sized to fit exactly onto the neck of the bottle, thereby offering no means to grasp it with two fingers to peel it off, and the heat activated adhesive used to glue it is usually very strong. Therefore, the seal must be pierced and then teared off, with the inherent risk of splash and contact of the body with the bleach contained in the the bottle.

To solve the second and most important drawback listed hereinabove, it has already been proposed to make a plurality of very small perforations into the aluminum seal to let gases pass therethrough. This solution is efficient but does not solve the first and third drawbacks. Moreover, it has the drawback of letting some bleach or liquid soak the permanent membrane, which is often made of paperboard.

To solve the third drawback listed hereabove, it has also been proposed to provide the aluminum seal with an outwardly projecting grasping tab. Such a solution however substantially complicates the lining process, as a third protective seal must be intercalated between the permanent and peelable seals to protect the tab and prevent it from being glued. Moreover, this solution has the same drawback as mentioned above.

SUMMARY OF THE INVENTION

The object of the present invention is to provide a bottle assembly of the above mentioned type, including both a permanent and peelable seals, which does not have any of the above mentioned drawbacks.

More particularly, the object of the invention is to provide a bottle assembly including a permanent breathing seal made of a porous plastic foam held within the cap of the bottle, and a peelable breathing seal that is (a) made of the very same porous plastic foam as the permanent seal, (b) mounted onto the neck of the bottle in a very simple manner without any specific requirement such as the use of spots of wax and/or the application of heat, and (c) sized so as to be easily graspable and peelable with two fingers with reduced risk of contact with the liquid contained in the bottle.

In accordance with the invention, the above mentioned object is achieved with a bottle assembly of the above mentioned type, wherein:

the permanent breathing seal is freely mounted within the cap adjacent the flat inside top wall thereof;

a peelable breathing seal made of the same porous plastic foam as the permanent seal is provided to sealingly close the circular opening of the bottle until the same is opened for the very first time, said peelable seal being in the form of a thin disk that is sized to extend across the opening of the neck and is glued to the upper edge thereof, said disk having an external diameter larger than the external diameter of the upper edge of neck to define an annular flap projecting outwardly from the neck around all the periphery of the upper edge thereof, said flap allowing the peelable seal to be grasped of with two fingers and easily peeled off whenever desired.

Advantageously, the cap is formed with retaining means inwardly projecting from the skirt close to the top wall to prevent the permanent seal from falling out of the cap when the same is removed from the neck of the bottle and also to hold the peelable seal during original capping of the bottle. Moreover, the peelable seal has a bottom surface coated with a thin layer of a pressure activated adhesive that adheres to the plastic material of the bottle when pressed on it for a given period of time and is inert to said liquid substance and gases.

When the liquid substance contained in the bottle is a bleach, the bottle is preferably made of polyethylene; its cap of polypropylene copolymer or polyethylene; and the permanent and peelable seals of expanded polystyrene.

They are no specific requirement as to the thicknesses of both seals. In both cases, it is only necessary that they be thick enough to be sufficiently rigid to be held within the cap and, for the permanent seal, to provide the required sealing when the bottle is closed by the cap. In practice, the permanent and peelable seals may be about 0.040 and 0.020 inch thick, respectively.

As can be appreciated, the improved bottle assembly according to the invention is very simple yet efficient. The peelable seal that is made of porous foam allows the bottle to breath and simultaneously prevents the liquid from leaking for a given period of time that may be as long as five minutes if the bottle is knocked over and the cap has been partially unscrewed or removed. This peelable seal is fixable to the neck by mere pressure applied from a given period of time, without any requirement for heat. In accordance with a very important aspect of the invention, such a fixation of the peelable seal by pressure however may properly be achieved only if both seals, i.e. the permanent and peelable seals, are free to rotate within the cap when the same is screwed onto the neck during the capping process, thereby making it compulsory for the permanent seal not to be glued or otherwise attached to the inside top wall of the cap. Indeed, it has been found that if such a freedom of rotation is absent, the pressure adhesive on the bottom surface of the peelable seal may be scratched or the seal may become pleated during the capping process, and thus causes leaks.

The structure and advantages of the improved bottle assembly according to the invention will be better understood upon reading the following non restrictive description of two preferred embodiments thereof, given with reference to the accompanying drawings.

DESCRIPTION OF TWO PREFERRED EMBODIMENTS

Figure 1:
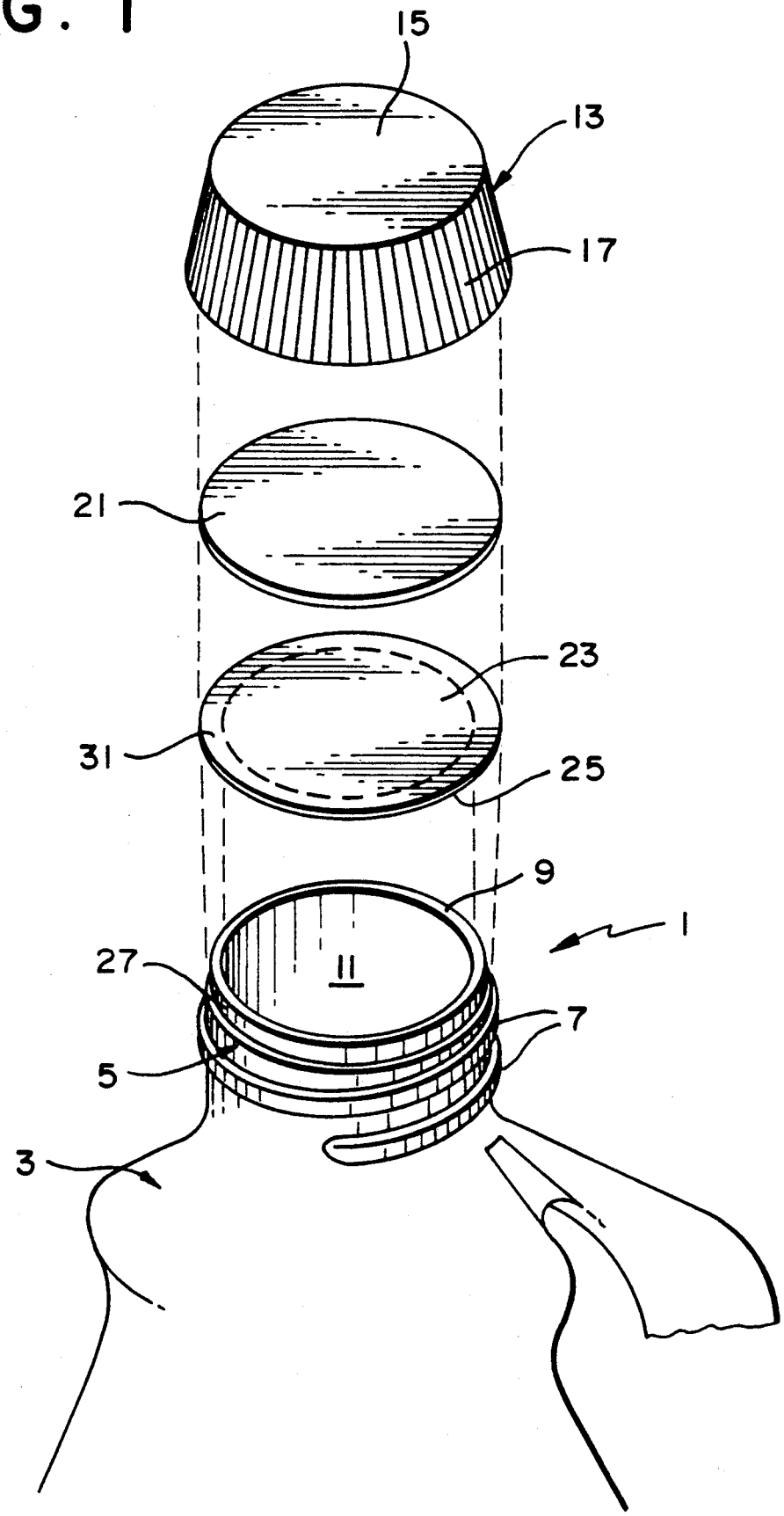
FIG. 1 is an exploded perspective view of the upper portion of an improved bottle assembly according to a first embodiment of the invention.
Figure 2:
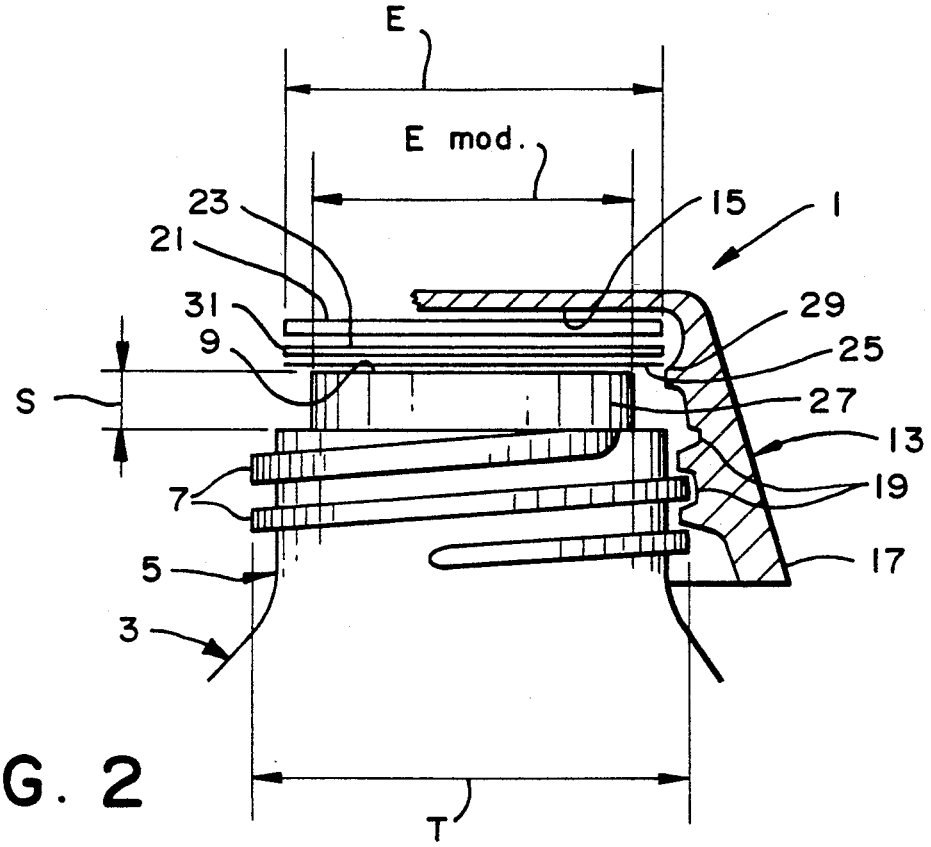
FIG. 2 is a partial side elevational, cross-sectional view of the upper portion of the improved bottle assembly shown in FIG. 1.

The improved bottle assembly 1 according to the first embodiment of the invention as shown in FIGS. 1 and 2, is intended to be used for storing and retailing bleach like Javel water. It may be understood however that the same assembly could also be used to store and retail any other kind of liquid substance that may generate gases under specific circumstances, such as application of heat or contamination with another substance.

The bottle assembly 1 comprises a bottle 3 made of a plastic material such as polyethylene, that is inert to the bleach and gases such as oxygen or chlorine that may be generated by the same. The bottle 3 has a cylindrical neck 5 having threads 7 on its external surface and an upper edge 9 that defines an opening 11.

The bottle assembly 1 also comprises a cap 13 sized to fit onto the neck 5. The cap 13 which can be made of polypropylene copolymer or polyethylene, has a flat inside top wall 15 that is circular in shape, and a surrounding skirt 17 that downwardly projects from the periphery of the top wall and has an internal surface with threads 19 compatible with those of neck to make the cap screwable onto this neck 5.

In this embodiment of the invention which is the most preferred one, the cap 13 is of the "unscrewed thread" type (such a definition being used in the art to classify caps according to their method of manufacture). Thus, it comprises a skirt 17 whose internal diameter is substantially equal to or slighter larger than the external average diameter E of the neck 5.

The bottle assembly 1 further comprises a permanent breathing seal 21 in the form of a disk that is made of a porous plastic foam such as expanded polystyrene, that is inert to the bleach and has a porosity selected to allow the gases to pass therethrough but not the liquid bleach. This disk that may for example be 0.040 inch thick, has a diameter substantially equal to or slightly smaller than the internal diameter of the skirt 17 so as to fit within the cap 13 and extend flat against the flat inside top wall 15 thereof, and to bear against the upper edge 9 of the neck 5 to seal the bottle 3 while allowing it to breath when the cap 13 is screwed onto the neck 5.

In accordance with a first original aspect of the invention, the bottle assembly 1 additional comprises a peelable breathing seal 23 made of the very same porous foam as the permanent seal 21 to sealingly close the circular opening 11 of the bottle until the same is opened for the very first time. This seal 23 which is in the form of a thin disk that may for example be 0.020 inch thick, has a bottom surface coated with a thin layer 25 of a pressure activated adhesive that adheres to the plastic material of the bottle when pressed on it for a given period of time and is inert to the bleach and gases that may be generated by the same. Sheets of polystyrene already coated with a layer pressure actuated adhesive optionally covered with appropriate powder and meeting the above requirements, are presently available in the trade under the trade mark TAMPER SEAL (Insulek, a division of UNPAK) or FOAMSEAL PS 22 (Teckniplex). Accordingly, it needs not be further described.

The peelable seal 23 which as an external diameter substantially identical to the one of the permanent seal 21, extends across the opening 11 of the neck 5 and is intended to be glued to the upper edge 9 thereof.

In accordance with another original aspect of the invention, the neck 5 has a upper portion 27 that is of a smaller external diameter E mod. as compared to the average diameter E of the neck over a given high S of say 0.080 inch. The purpose of this narrower upper edge portion is to give room both laterally and vertically to a small annular flange 29 that is integral to the skirt 17 and projects outwardly from the internal surface of this skirt at a short distance away from the bottom wall 15 of the cap 13, such a short distance being at least equal to and preferably slightly bigger than the total thickness of the permanent and peelable seals 21 and 23. The annular flange 29 acts as a retaining means whose purpose is essentially to prevent the permanent seal 21 from falling out of the cap 13 when the same is removed from the neck 5 of the bottle 3 and also to hold the peelable seal 23 during capping of the bottle.

During such a capping, the seals 21 and 23 are inserted into the cap 13 so as to extend flat onto the inside top wall 15 thereof and be retained in such a position by the flange 29 which is devised and sized for this purpose. Then, the cap 13 is screwed onto the neck 5. Thanks to the narrower upper edge portion 27 of the neck, the cap 13 may be screwed down until the bottom surface of the peelable seal 23 covered with the layer of pressure activated adhesive 25 comes into contact with and is tightly pressed onto the upper edge 9 of the neck 5. As a result of such a pressing which is uniformly distributed due to the presence of the permanent seal 21 sandwiched between the bottom wall 15 of the cap and the peelable seal 23, the latter is glued in a very efficient manner to the upper edge 9 of the neck 5, thereby making the bottle liquid tight even if it is knocked over. As this seal 23 is made of polystyrene, it lets however the bottle breathe and thus prevents it from bulging under normal circumstances as may occur if use is made of an aluminum seal. It may be noted and appreciated here that no heat is required to achieved the required gluing of the peelable seal.

In accordance with a further important aspect of the invention, it is compulsory that the permanent seal 21 be not glued or otherwise attached to the inside top wall 15 of the cap 13. It is indeed essential that the permanent and peelable seals are free to rotate within the cap when the same is secured onto the neck of the bottle during the capping process to avoid the pressure activate adhesive layer 25 being inadvertently scratched and become inefficient.

As may be noticed, and this is still another important aspect of the invention, the difference in size between the diameter E of the peelable seal 23 and the external diameter E mod. of the upper portion 27 of the neck 5, causes the other periphery of the peelable seal 23 to define an annular flap 31 that projects outwardly from the neck all around the upper edge thereof. Such a flat 31 is important in that it allows the peelable seal 21 to be grasped with two fingers and be easily peeled off whenever desired, without having to pierce it and thus risking being splashed with bleach.

Of course, the distance between the annular flange 29 and the bottom walls is of the cap 13 and the height S of the upper portion 27 of the neck 5 must also be selected to allow the cap to be "sufficiently" screwed onto the neck to bring the permanent seal 21 into contact with the upper edge 9 of the neck even after the peelable seal 23 is removed, to close and seal again the bottle after it has been opened for the very first time.

As may be appreciated, the annular flange 29 acting as a seal retaining means, needs not be in the form of a continuous ring. As a matter of fact , it may consist of three or more tabs sufficiently spaced apart to retain the seals 21 and 23.

Figure 3:
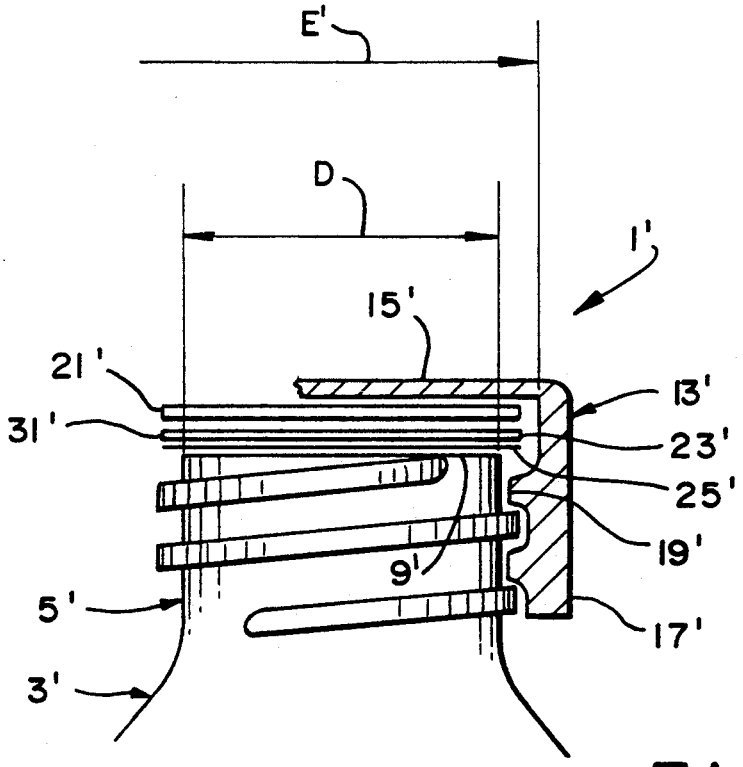
FIG. 3 is a partial, side elevational, cross-sectional view of the upper portion of an improved bottle assembly according to a second embodiment of the invention.

FIG. 3 shows another embodiment of the invention, which is very similar to the first embodiment disclosed hereinabove, except that the cap 13' is now of the "stripped thread" type and thus has a skirt 17' with an internal diameter E' that is larger than the external average diameter D of the neck 5'. For the sake of simplicity, the same reference numerals with a distingushing prime (') have been used in this figure to identify the same structural elements as already shown in FIGS. 1 and 2.

As may be noted, the bottle assembly 1' shown in FIG. 3 also comprises a permanent seal 21' and a peelable seal 23' glued to the upper edge 9' of the neck 5'. Both seals 21', 23' are freely mounted with the cap 13' adjacent the inside top wall 15' thereof, and are held therein by a retaining means which, in the present case, may consist of the upper thread 19' that projects outwardly from the internal surface of the skirt 17'.

Once again, the difference in size between the diameter of the seals 21' and 23' which is substantially identical to ' the internal diameter E' of the cap 13' and thus larger than the external diameter D of the neck 5', causes the outer periphery of the peelable seal 23' to define an annular flat 31' allowing the seal 23' to be grasped with two fingers and peeled off.

Of course, minor modifications could be made to the bottle assemblies that have been disclosed hereinabove, without departing from the scope of the present invention as defined in the appended claims.

We claim:

1. In a bottle assembly for storing and retailing a liquid substance generating gases whenever heated or contaminated, said bottle assembly comprising:

a bottle made of a plastic material that is inert to said liquid substance and gases, said bottle comprising a cylindrical neck with a threaded external surface and a circular upper edge of a given external diameter that defines a circular opening;

cap sized to fit onto said neck, said cap having a flat inside top wall that is circular in shape, and a surrounding skirt that downwardly projects from the periphery of said wall and has an internal surface that is stretched as to make said cap screwable onto said neck of the bottle; and a permanent breathing seal in the form of a disk seal made of a breathable plastic foam that is inert to the liquid substance and has a porosity selected to allow the gases to pass therethrough but not the liquid substance, said disk being sized to fit within said cap and extend flat against the wall thereof, and to bear against the circular upper edge of the neck to seal the bottle while allowing it to breath when the cap is screwed onto said neck, the improvement wherein:

the permanent breathing seal is freely mounted within the cap adjacent the flat inside top wall thereof;

a peelable breathing seal made of the same breathable plastic foam as the permanent seal is provided to sealingly close the circular opening of the bottle until the same is opened for the very first time, said peelable seal being in the form of a thin disk that is sized to extend across the circular opening and is glued to the upper edge thereof, said disk having an external diameter larger than the external diameter of the upper edge of neck to define an annular flop projecting outwardly from the neck around all the periphery of the upper edge thereof, said flap allowing the peelable seal to be grasped with two fingers and easily peeled off whenever desired.

2. The improved bottle assembly of claim 1, wherein said cap is formed with retaining means inwardly projecting from the skirt close to the inside top wall to prevent the permanent seal from falling out of the cap when the same is removed from the neck of the bottle and also to hold the peelable seal during original capping of the bottle.

3. The improved bottle assembly of claim 2, wherein the peelable seal has a bottom surface coated with a thin layer of a pressure activated adhesive that adheres to the plastic material of the bottle when pressed on it for a given period of time and is inert to said liquid substance and gases.

4. The improved bottle assembly of claim 3, wherein said cap is of the "stripped thread" type and thus has a skirt with an internal diameter larger than the external diameter of the neck, and said retaining means consist of a thread projecting outwardly from the internal surface of the skirt close to the wall of said cap.

5. The improved bottle assembly of claim 4, wherein said liquid substance is a fabric bleach;

said plastic material of which the bottle is made is a polyethylene plastic material; and said breathable plastic foam of which said permanent and peelable seals are made is an expanded polystyrene foam.

6. The improved bottle assembly of claim 3, wherein said cap is of the "unscrewed thread" type and thus comprises a skirt with an internal diameter slightly larger than the external diameter of the neck, said retaining means consist of a small annular flange that projects outwardly from the internal surface of the skirt at a short distance from the inside top wall of the cap, said short distance being at least equal to the total thickness of the permanent and peelable seals, and said neck has a upper portion that is of a smaller external diameter than said threaded external surface over a given height said smaller diameter which actually corresponds to the internal diameter of the small annular flange and said given height being selected to give room both laterally and vertically to the small annular flange and thus allow the cap to be screwed onto the neck until the permanent seal is tightly pressed onto the upper edge of said neck.

7. The improved bottle assembly of claim 6, wherein said liquid substance is a fabric bleach;

said plastic material of which the bottle is made is a polyethylene plastic material; and said breathable plastic foam of which said permanent and peelable seals are made is an expanded polystyrene foam.

8. The improved bottle assembly of claim 7, wherein said permanent seal has a thickness of about 0.040 inch and said peelable seal has a thickness of about 0.020 inch.

* * * * *